US009605324B2

(12) United States Patent
Sarir et al.

(10) Patent No.: US 9,605,324 B2
(45) Date of Patent: Mar. 28, 2017

(54) COMPOSITIONS AND PROCESSES FOR CLARIFICATION OF SUGAR JUICES AND SYRUPS IN SUGAR MILLS

(75) Inventors: Emmanuel M. Sarir, Los Angeles, CA (US); James Bushong, Collegeville, PA (US)

(73) Assignee: Carbo-UA Limited, Beverly Hills, CA (US)

( * ) Notice: Subject to any disclaimer, the term of this patent is extended or adjusted under 35 U.S.C. 154(b) by 0 days.

(21) Appl. No.: 12/970,387

(22) Filed: Dec. 16, 2010

(65) Prior Publication Data

US 2011/0174303 A1 Jul. 21, 2011

Related U.S. Application Data

(60) Provisional application No. 61/289,704, filed on Dec. 23, 2009.

(51) Int. Cl.
*C13B 20/00* (2011.01)
*C13B 20/12* (2011.01)

(52) U.S. Cl.
CPC ..... *C13B 20/005* (2013.01); *C13B 20/12* (2013.01); *C13B 20/123* (2013.01)

(58) Field of Classification Search
None
See application file for complete search history.

(56) References Cited

U.S. PATENT DOCUMENTS

| | | | | |
|---|---|---|---|---|
| 1,646,079 | A | 10/1927 | Battelle | |
| 1,788,466 | A | 1/1931 | Lourens | |
| 1,815,276 | A | 7/1931 | Schwieger | |
| 1,956,260 | A * | 4/1934 | Wadsworth | C13B 20/005 127/48 |
| 2,067,362 | A | 1/1937 | Von Stietz | |
| 2,104,959 | A | 1/1938 | von Stietz | |
| 2,170,601 | A | 8/1939 | Wilson et al. | |
| 2,194,195 | A * | 3/1940 | Feurtado | 127/48 |
| 2,249,920 | A | 7/1941 | Taussig et al. | |
| 2,261,920 | A * | 11/1941 | Graff | C13B 20/123 127/55 |
| 2,430,262 | A | 11/1947 | Vincent et al. | |
| 2,652,152 | A * | 9/1953 | Frankenhoff | 210/778 |
| 2,672,428 | A * | 3/1954 | Sklar | C13B 10/14 127/44 |
| 2,829,986 | A | 4/1958 | Ehrhart | |
| 2,977,253 | A | 3/1961 | Grandadam et al. | |
| 3,097,114 | A | 7/1963 | Assalini | |
| 3,166,442 | A | 1/1965 | Duke | |
| 3,248,264 | A | 4/1966 | Welch | |
| 3,420,709 | A * | 1/1969 | Barrett, Jr. | B01D 15/00 127/46.2 |
| 3,454,502 | A | 7/1969 | Hiltgen et al. | |
| 3,539,393 | A * | 11/1970 | Remsen et al. | 127/51 |
| 3,698,951 | A | 10/1972 | Bennett | |
| 3,806,364 | A | 4/1974 | Gasco | |
| 3,853,616 | A | 12/1974 | Rundell et al. | |
| 3,909,287 | A | 9/1975 | Rundell et al. | |
| 3,973,986 | A | 8/1976 | Schoenrock et al. | |
| 4,081,288 | A * | 3/1978 | Torres | 127/48 |
| 4,101,338 | A | 7/1978 | Rapaport et al. | |
| 4,196,017 | A | 4/1980 | Melville et al. | |
| 4,247,340 | A * | 1/1981 | Cartier | B01J 41/14 127/46.2 |
| 4,288,551 | A | 9/1981 | Gudnason et al. | |

(Continued)

FOREIGN PATENT DOCUMENTS

| | | | |
|---|---|---|---|
| CN | 85108102 | A | 5/1987 |
| CN | 1040624 | A | 3/1990 |

(Continued)

OTHER PUBLICATIONS

Review of Proven Technologies available for the reduction of Raw Sugar Color. Proc S Afr Sug Technol Ass (2008) 81, 165-183). Madho et al.*
Office Action issued in U.S. Appl. No. 12/893,514 dated Jun. 28, 2013.
Office Action issued in U.S. Appl. No. 12/893,514 dated Mar. 6, 2014.
Davis, SB, The Chemistry of Colour Removal: A Processing Perspective, Procs Afr Sug Technol Assoc, 2001; 75:328336.
Supplementary European Search Report of European Application No. EP10830731 dated Feb. 26, 2014.
Supplementary European Search Report of European Application No. EP10830732 dated Mar. 12, 2014.
Supplementary European Search Report of European Application No. EP10840101.9 dated Mar. 21, 2014.

(Continued)

*Primary Examiner* — Melvin C Mayes
*Assistant Examiner* — Colette Nguyen
(74) *Attorney, Agent, or Firm* — Venable, LLP

(57) ABSTRACT

This invention relates to compositions and processes for improving the clarification of sugar juices and syrups in sugar mills. The process involves adding compositions directly to the juice and or syrup. The compositions provided in this invention are mixed intimately into the sugar juices or syrups, and allowed sufficient time to react with the sugar juices or syrups as well as with the any other chemicals added in the clarification processes so as to impart an improvement in the purity of the clarified juice or syrup obtained therefrom. Compositions include at least one particulate sulfur reagent containing at least one sulfur atom and at least three oxygen atoms, and one or more particulate solids selected from the group consisting of (A) a silica reagent, (B) a particulate phosphorous reagent containing at least one phosphorous atom and at least three oxygen atoms in the chemical formula, (C) a particulate carbonaceous reagent, (D) a particulate aluminum reagent containing at least one aluminum atom and at least three oxygen atoms in the chemical formula, (E) a particulate filter aid, (F) a polymer decolorant, (G) a particulate ammonium reagent having at least one ammonium group ($NH_4$) in the chemical formula, and (H) a bleaching earth.

10 Claims, No Drawings

(56) References Cited

U.S. PATENT DOCUMENTS

| | | | | |
|---|---|---|---|---|
| 4,292,285 | A | 9/1981 | Nakao et al. | |
| 4,345,947 | A * | 8/1982 | Rundell | C13K 1/08 127/48 |
| 4,382,823 | A * | 5/1983 | Gudnason | C13B 20/005 127/48 |
| 4,478,645 | A | 10/1984 | Gudnason | |
| 4,502,890 | A | 3/1985 | Urbanic | |
| 4,737,293 | A | 4/1988 | Walterick et al. | |
| 5,262,328 | A * | 11/1993 | Clarke | C13B 20/005 106/217.6 |
| 5,281,279 | A * | 1/1994 | Gil | B03D 1/02 127/46.1 |
| 5,865,899 | A | 2/1999 | Theoleyre et al. | |
| 5,891,254 | A | 4/1999 | Coville et al. | |
| 5,932,016 | A | 8/1999 | Paananen et al. | |
| 6,146,465 | A | 11/2000 | Xavier et al. | |
| 6,159,302 | A | 12/2000 | Xavier et al. | |
| 6,267,889 | B1 * | 7/2001 | Woerner | 210/636 |
| 6,368,413 | B1 | 4/2002 | Charlet et al. | |
| 6,375,751 | B2 | 4/2002 | Reisig et al. | |
| 6,835,311 | B2 | 12/2004 | Koslow | |
| 8,080,088 | B1 | 12/2011 | Srinivasachar | |
| 8,486,473 | B2 * | 7/2013 | Sarir et al. | 426/533 |
| 8,486,474 | B2 * | 7/2013 | Sarir | C13B 20/06 426/533 |
| 2001/0001178 | A1 | 5/2001 | Donovan et al. | |
| 2002/0011246 | A1 | 1/2002 | Reisig et al. | |
| 2005/0229813 | A1 * | 10/2005 | Dionisi | C13B 20/02 106/162.1 |
| 2006/0090749 | A1 * | 5/2006 | Rein et al. | 127/46.1 |
| 2007/0224332 | A1 * | 9/2007 | Sugimoto et al. | 426/597 |
| 2007/0275119 | A1 * | 11/2007 | Lakkis | 426/3 |
| 2009/0050135 | A1 | 2/2009 | Zschau et al. | |
| 2012/0216799 | A1 | 8/2012 | Bolanos | |

FOREIGN PATENT DOCUMENTS

| | | | |
|---|---|---|---|
| CN | 1045420 | A | 9/1990 |
| CN | 1300857 | A | 6/2001 |
| CN | 1560281 | A | 1/2005 |
| CN | 1609234 | A | 4/2005 |
| CN | 1629320 | A | 6/2005 |
| CN | 1687461 | A | 10/2005 |
| CN | 1912143 | A | 2/2007 |
| CN | 1958811 | A | 5/2007 |
| CN | 101003370 | A | 7/2007 |
| CN | 101003842 | A | 7/2007 |
| CN | 101082065 | A | 12/2007 |
| CN | 101243194 | A | 8/2008 |
| CN | 101440412 | A | 5/2009 |
| CN | 101818214 | A | 9/2010 |
| EP | 0635578 | A1 | 1/1995 |
| JP | 58014933 | | 1/1983 |
| MX | 2007016295 | A | 6/2009 |
| WO | WO-96/15274 | A1 | 5/1996 |
| WO | WO-99/55918 | A2 | 11/1999 |
| WO | WO-00/42226 | A1 | 7/2000 |
| WO | WO-2011/059601 | R3 | 11/2010 |
| WO | WO-2011/060168 | R3 | 1/2011 |
| WO | WO-2011/059601 | A1 | 5/2011 |
| WO | WO-2011/060168 | A1 | 5/2011 |
| WO | WO-2011/060169 | A1 | 5/2011 |
| WO | WO-2011/079172 | A1 | 6/2011 |
| WO | WO-2011/060169 | R3 | 5/2012 |

OTHER PUBLICATIONS

Office Action issued in U.S. Appl. No. 13/940,979 dated Jul. 24, 2014.

Final Office Action issued in U.S. Appl. No. 13/940,979 dated Feb. 26, 2015.

Office Action issued in U.S. Appl. No. 13/940,970 dated Jul. 24, 2014.

Final Office Action issued in U.S. Appl. No. 13/940,970 dated Apr. 3, 2015.

Office Action issued in U.S. Appl. No. 12/893,514 dated Aug. 4, 2014.

Office Action issued in U.S. Appl. No. 12/893,514 dated Nov. 19, 2014.

Office Action issued in U.S. Appl. No. 12/893,514 dated Mar. 13, 2015.

Abdel-Razig et al., "Effect of Addition of Separan at Different Concentrations as Flocculants on Quality of Sugar Cane Juice," International Journal of Biological and Life Sciences, 2010, pp. 88-91, vol. 6, No. 2.

Cane Sugar Handbook, 12th Ed., pp. 454-455, publishing date 1993.

Cane Sugar Handbook, 12th Ed., pp. 463-464, publishing date 1993.

Cane Sugar Handbook, 12th Ed., pp. 634, publishing date 1993.

International Preliminary Report on Patentability issued in Application No. PCT/US2010/051501 dated May 15, 2012.

International Preliminary Report on Patentability issued in Application No. PCT/US2010/056380 dated May 15, 2012.

International Search Report issued in Application No. PCT/US2010/051501 dated Nov. 30, 2010.

International Search Report issued in Application No. PCT/US2010/05638 dated Jan. 13, 2011.

International Search Report issued in Application No. PCT/US2010/056381 dated Feb. 28, 2011.

Office Action issued in U.S. Appl. No. 12/893,514 dated Jul. 26, 2012.

Office Action issued in U.S. Appl. No. 12/893,514 dated Sep. 27, 2011.

Office Action issued in U.S. Appl. No. 12/942,078 dated Jun. 8, 2012.

Office Action issued in U.S. Appl. No. 12/942,082 dated Jun. 14, 2012.

Written Opinion of the International Searching Authority issued in Application No. PCT/US2010/056381 dated Feb. 28, 2011.

Written Opinion of the International Searching Authority issued in Application No. PCT/US2010/061728 dated Feb. 24, 2011.

International Search Report of International Application No. PCT/US10/61728, dated Feb. 2011.

* cited by examiner

COMPOSITIONS AND PROCESSES FOR CLARIFICATION OF SUGAR JUICES AND SYRUPS IN SUGAR MILLS

BACKGROUND OF THE INVENTION

1. Field of the Invention

The present invention relates generally to methods of treating sugar juices, syrups, and related products, offering compositions of matter and processes incorporating the same.

2. Description of the Prior Art

In the sugar milling process, a sucrose-bearing juice is obtained by extracting the juices from a suitable plant source such as sugar cane. The impure juice is clarified in the sugar mill, typically with a sulfitation process. In the sulfitation process, sulfur is burned in air, to form sulfur dioxide gas. The impure sugar juice is passed through sulfitation towers wherein the sulfur dioxide gas is typically passed counter-currently to the juice. The sulfitation towers can contain perforated trays to enhance the contact of sulfur dioxide gas with the juice. Lime is added to the juice, to neutralize the natural acidity of the juice, as well as the acidity introduced by the sulfur dioxide. The lime also serves to form multiple insoluble calcium precipitates. A polymer flocculant, such as a polyacrylamide, is normally added to the juice just prior to the clarifier, to assist in the settling rate of impurities. The juice is heated to approximately 105 Celsius, and introduced to clarifier tanks where the juice is maintained at 90-105 Celsius for approximately 45 minutes to 2 hours, while various impurities settle to the bottom of the juice clarifier. The clarified juice taken from the top of the clarifier is then evaporated to raw syrup. The raw syrup may optionally undergo a syrup flotation-type clarification where the impurities are removed from the top of the clarifier. If utilized, the syrup clarification typically uses phosphoric acid, lime, and polymer flocculant; aeration enables the impurities to float to the top of the clarifier where they are removed as scums. The sugar syrup (whether clarified in a syrup clarifier or not) is crystallized to form crystals sugars for consumption, or for further refining in a sugar refinery.

More recent processes for sugar juices and syrup clarification include those exemplified by U.S. Pat. No. 5,281,279 to Gil et al. This patent describes a process for producing refined sugar from raw sugar juices. The process includes adding a flocculant for treating raw sugar juice, wherein the flocculant is selected from the group of lime, a source of phosphate ions, polyelectrolyte, and combinations thereof. The thus treated juice is concentrated by evaporation to form a syrup, with a subsequent treatment by flocculant, then filtered, and then decolorized and de-ashed using ion-exchange resin.

In U.S. Pat. No. 4,247,340, Cartier claims a process for purifying impure sugar solutions, including simultaneous decolorization and clarification, comprising contacting the impure sugar solutions with submicroscopic ion-exchange resin in the forms of approximately spherical beads, said ion-exchange resin having diameters from about 0.01 to 1.5 microns, followed by separation of this ion-exchange resin from the sugar solution. The ion-exchange resin particles may be separated in the form of a floc, wherein the floc may be formed either from impurities in the impure sugar solution, or by adding sufficient flocculating agent in the sugar solution to flocculate all of the resin particles.

Another example of more recently proposed sugar clarification includes that of U.S. Pat. No. 5,262,328 to Clarke et al, detailing a composition for the clarification of sugar bearing juices and related products. The composition comprises a dry, powdered admixture of aluminum chloride hydroxide, lime, and activated bentonite. The composition may also include a polymer flocculating agent, such as a polyacrylamide.

SUMMARY OF THE INVENTION

In light of the information described above, it is an object of the present invention to provide compositions of matter and processes using the same, for treating sugar juices, syrups, and related products in sugar mills (hereafter collectively referred to as "sugar solutions"). The compositions can provide impurity removal to the sugar solutions. Exemplary embodiments can provide for decolorization of the sugar solutions and an improved purity crystal sugar produced therefrom as measured by the color of the crystal sugar. The compositions provided in this invention are mixed intimately into the sugar solutions, and allowed sufficient time to react with the sugar solutions so as to impart some impurity removal from the sugar solution.

The invention includes a composition for use in a process of clarifying a sugar juice or liquor. The composition includes at least one particulate sulfur reagent containing at least one sulfur atom and at least three oxygen atoms, and one or more particulate solids selected from the group consisting of (A) a silica reagent, (B) a particulate phosphorous reagent containing at least one phosphorous atom and at least three oxygen atoms in the chemical formula, (C) a particulate carbonaceous reagent, (D) a particulate aluminum reagent containing at least one aluminum atom and at least three oxygen atoms in the chemical formula, (E) a particulate filter aid, (F) a polymer decolorant, (G) a particulate ammonium reagent having at least one ammonium group ($NH_4$) in the chemical formula, and (H) a bleaching earth. In embodiments, the composition will include at least one particulate silica reagent. In some embodiments, the composition include at least one bleaching earth in addition to the particulate sulfur reagent and the optional particulate silica reagent. In still other embodiments, the composition includes at least one particulate aluminum reagent in addition to the particulate sulfur reagent and the optional particulate silica reagent and/or bleaching earth. Exemplary compositions according to any of the above recited embodiments also include at least one particulate carbonaceous reagent, and/or at least one particulate phosphorous reagent.

In exemplary embodiments, the particulate sulfur reagent is sodium metabisulfite, sodium hydrosulfite or a mixture thereof. In some embodiments, the particulate silica reagent is amorphous silica. In embodiments, the particulate aluminum reagent is polyaluminum chloride and/or the particulate carbonaceous reagent is powder activated carbon. Exemplary particulate phosphorous reagents include monosodium phosphate or monoammonium phosphate.

In exemplary embodiments, the process of clarifying a sugar juice or liquor includes adding one of the compositions to a sugar juice or liquor. The composition can be added as singular components, a combination of some components as singular components and other components as a premixture of components or the components can be added as a pre-manufactured mixture. The composition can be added to the sugar juice or syrup in the juice or syrup clarifier tank or prior to reaching the juice or syrup clarifier tank.

The present invention provides advantages over existing methodologies that have not been previously realized. The invention can enable increased capacity and throughput in the sugar mill process. This can allow for an increased production per unit time or a decrease in the time required for producing the same amount of sugar. The compositions and process of the present invention can also provide a lower color crystal sugar following the clarification process. The lower color crystal sugars can potentially be sold at a market premium compared to higher color crystal sugars. If the crystal sugar produced in the mill is to be further processed into refined sugar (in a sugar refinery), the lower color crystal sugar can lower the costs and complexity required to convert the mill-produced crystal sugar into suitable quality refined-grade crystal sugar.

Further novel features and other objects of the present invention will become apparent from the following detailed description, discussion and the appended claims.

DETAILED DESCRIPTION OF EMBODIMENTS

Although specific embodiments of the present invention will now be described, it should be understood that such embodiments are by way of example only and merely illustrative of but a small number of the many possible specific embodiments which can represent applications of the principles of the present invention. Changes and modifications by persons skilled in the art to which the present invention pertains are within the spirit, scope and contemplation of the present invention as further defined in the appended claims.

The present process involves adding compositions either to the juice or syrup in a sugar mill. The compositions provided in this invention are mixed intimately into the sugar juices or syrups, and the sugar juices or syrups allowed to react with the added composition, as well as with the any other chemicals added in the juice or syrup clarification process, so as to impart an improvement in the purity of the clarified juice or syrup obtained therefrom.

In exemplary embodiments, the particle size of in the composition can be in the range of, or have an average particle size in the range of, for example, from about 0.01 micron up to about 300 microns; from about 1 micron to about 300 microns; from about 30 microns to about 300 microns; or from about 50 microns to about 250 microns.

The term "polymer decolorant" as defined herein, refers to organic polymers that are frequently classified as a color precipitant for use in sugar solutions, and can typically be a liquid or waxy substance. Any polymer decolorant that can be used in sugar purification processing is acceptable, for example, those that contain a positive charge on a nitrogen atom. Exemplary polymer decolorants include dimethylamine-epichlorohydrin polymers such as Magnafloc LT-31, dimethyldialkylammonium chloride polymers such as Magnafloc LT-35 supplied by Ciba Chemicals, and dimethyl-ditallow ammonium chloride. The polymer decolorant can be prepared as a diluted solution in water or other suitable solvent; unless otherwise indicated, the weight percent of the polymer decolorant of the mixture is defined herein as the weight percent of the polymer solution added to the mixture, regardless of whether the polymer solution is added in the "as-is commercially available state" (typically 30-50% solids content) or in a "further diluted state" with water or other suitable solvent. If the polymer decolorant is first diluted in water or other suitable solvent, it can be diluted from about 5 to 95% by weight of polymer in the "as-is commercially available state" with respect to the solvent, for example from about 10 to 80% by weight of polymer in the "as-is commercially available state", or from about 40 to 75% by weight of polymer in the "as-is commercially available state", with the balance comprising of water or other suitable solvent. In other examples, the commercially available polymer decolorant can be diluted with water in a ratio of from about 3:1 commercially available decolorant to water to about 1:3 commercially available decolorant to water. For example, polymer decolorant solutions can be prepared by adding about three parts of the commercially available reagent to about one part water, or about 2 parts of the commercially available reagent to about 1 part water, or about 1 part of the commercially available reagent to about 1 part of water, or about 1 part of the commercially available reagent to about 2 parts of water, or about 1 part of the commercially available reagent to about 3 parts of water. Aqueous solutions, for example a sugar solution of a solution containing one or more particulate reagents as described herein, can be used to dilute the commercially available polymer decolorant instead of pure water. Diluting the polymer decolorant from the "as-is commercially available state" can facilitate mixing of the polymer decolorant with various powders according to various embodiments of the present invention.

The term "sugar juices or syrups" as used herein refers to any juice or syrup containing sugars derived from a plant source. In exemplary embodiments, the sugar is derived from a plant source, such as, for example, corn, cane or beets. Examples of sugar juices and/or syrups include solutions of cane or beet sugar juices or syrups, starch hydrolyzate derived sweeteners such as high-fructose corn syrup and glucose, or others that are used in the art.

Several compositions of matter have been identified for incorporation in the process of the present invention. The compositions can include one or more components selected from a particulate sulfur reagent, a particulate phosphorous reagent, a particulate aluminum reagent, a particulate silica reagent, a particulate carbonaceous reagent, a particulate bleaching earth, and a polymer decolorant. Some of the components of the present compositions have been previously utilized in the sugar mill clarification processes. However, it has been found that treatment with the compositions according to the present invention provides superior results and unexpected advantages over existing processes.

The particulate sulfur reagent is a particulate solid that includes at least one sulfur atom and at least three oxygen atoms in the chemical formula. For example, the solid can include a compound or ion having the formula $S_yO_x$ where y is generally 1-2, and $x \geq 2.0y$. In exemplary particulate sulfur reagents, when y=1, x is 3 or more, and when y=2, x=4 or more. Examples of particulate sulfur reagents include sulfite ($SO_3^{2-}$) salts, bisulfite ($HSO_3^-$) salts, sulfate ($SO_4^{2-}$) salts, hydrogen sulfate ($HSO_4^-$) salts, metabisulfite ($S_2O_5^{-2}$) salts, hydrosulfite ($S_2O_4^{-2}$) salts, and others. Specific examples include sodium sulfite, ammonium sulfite, sodium bisulfite, sodium metabisulfite, sodium sulfate, sodium bisulfate, and sodium hydrosulfite (sodium dithionite). Persons skilled in the art will recognize additional compounds that are suitable particulate sulfur reagents.

The particulate phosphorous reagent is a particulate solid that includes at least one phosphorous atom and at least three oxygen atoms in the chemical formula. For example, the solid can include a compound or ion having the formula $P_yO_x$ where y is generally 1-2, and $x \geq 2.0y$. In exemplary particulate phosphorous reagents, when y=1, x is 3 or more, and when y=2, x=4 or more. Examples of particulate phosphorous reagents include hydrogen phosphite ($HPO_3^{2-}$) compounds, monobasic phosphate ($H_2PO_4^{1-}$) compounds, dibasic phosphate compounds ($HPO_4^{2-}$), acid pyrophosphate ($H_2P_2O_7^{2-}$) compounds, and metaphosphate ($PO_3$)

compounds. Specific examples include sodium hydrogen phosphite ($Na_2HPO_3$), ammonium hydrogen phosphite, ($(NH_4)_2HPO_3$), sodium phosphate monobasic ($NaH_2PO_4$), calcium phosphate monobasic ($Ca(H_2PO_4)_2$), ammonium phosphate monobasic (or monoammonium phosphate, $(NH_4)H_2PO_4$), sodium phosphate dibasic ($Na_2HPO_4$), ammonium phosphate dibasic ($(NH_4)_2HPO_4$), and sodium acid pyrophosphate ($Na_2H_2P_2O_7$). Persons skilled in the art will recognize additional compounds that are suitable particulate phosphorous reagents.

The particulate aluminum reagent is a particulate solid selected from a group of aluminum compounds that comprise of at least one aluminum atom and at least three oxygen atoms in the chemical formula. Specific examples include aluminum ammonium sulfate ($AlNH_4(SO_4)_2$), aluminum hydroxychloride ($Al_2(OH)_5Cl$), aluminum oxide ($Al_2O_3$), aluminum potassium sulfate ($AlK(SO_4)_2$), aluminum sodium sulfate($AlNa(SO_4)_2$), aluminum sulfate ($Al_2(SO_4)_3$), and various permutations of compounds frequently referred to as polyaluminum chlorides or aluminum chlorohydrates that are designated by the general formula ($Al_nCl_{(3n-m)}(OH)_m$. Persons skilled in the art will recognize additional compounds that are suitable particulate aluminum reagents.

The silica reagent is a particulate solid that is classified as an amorphous silica or as an amorphous silicon dioxide (amorphous $SiO_2$). These silica reagents are sometimes also referred to as "precipitated silica." In embodiments, the silica reagent may be added as a sol gel.

The particulate carbonaceous reagent is a particulate solid that is classified as an activated carbon, and is interchangeably referred to herein as a particulate activated carbon. Any particulate activated carbon can be used; exemplary carbonaceous reagents include decolorizing activated carbons such as acid-activated decolorizing carbons. A particulate carbonaceous reagent can be any particulate carbonaceous reagent suitable for use in a sugar refining process. In exemplary embodiments, the particulate carbonaceous reagent can be in the range of, or have an average particle size in the range of, for example, from about 0.01 micron up to about 300 microns; from about 1 micron to about 300 microns; from about 5 microns to about 250 microns; or from about 50 microns to about 250 microns.

The particulate bleaching earth is any particulate solid classified as such as activated bleaching earth, acid-activated bleaching earth, fuller's earth, bentonite, hormite, smectite, and attapulgite clay.

The particulate ammonium reagent is a particulate solid containing a source of ammonium ($NH_4^+$). Specific examples include ammonium bicarbonate ($NH_4HCO_3$), ammonium phosphate dibasic ($(NH_4)_2HPO_4$), ammonium sulfite ($(NH_4)_2SO_3$), ammonium hydrogen phosphite, ($(NH_4)_2HPO_3$), and ammonium phosphate monobasic ($NH_4H_2PO_4$). In some embodiments, the particulate ammonium reagent is a compound that provides a source of ammonium ($NH_4^+$) that obtains a pH in water solution greater than 7.0. Persons skilled in the art will recognize additional compounds that are suitable particulate ammonium reagents.

Compositions according to the present invention can be added at any point in the juice clarification process and/or at any point in the syrup clarification process. The compositions can be added to the process as singular components, or they are first prepared as manufactured admixtures and added as a composite to the process. In some embodiments, one or more of the particulate reagents are mixed with a portion the sugar juice or syrup prior to being added. In general, compositions containing multiple components as described herein can in some cases offer greater improvement in the process. The number of different additives and the amount of each can be varied to obtain the desired amount of clarification.

Examples of compositions that are useful in the present invention include:

Exemplary Embodiment (1) A mixture according to this embodiment contains at least one particulate sulfur reagent is added either directly to the juice or syrup in the sugar mill clarification processes. Optionally, in addition to the particulate sulfur reagent, the composition can include one or more of the particulate phosphorous reagent, particulate aluminum reagent, particulate silica reagent, particulate carbonaceous reagent, particulate bleaching earth, and particulate ammonium reagent. In cases where an additional component is present, the particulate sulfur reagent can be present in an amount of from about 1% to about 99% (by weight), for example from about 10 to 99%, or from about 20 to 97% of the composition.

Exemplary Embodiment (2): A mixture containing at least one particulate sulfur reagent, and at least one particulate phosphorous reagent. In exemplary compositions according to this embodiment, the composition contains from about 1% to about 99% of the particulate sulfur reagent and from about 99% to about 1% of the phosphorous reagent. In other exemplary embodiments, the composition contains from about 10% to about 90% of the particulate sulfur reagent and from about 90% to about 10% of the phosphorous reagent. In still further exemplary embodiments, the composition contains about 60-80% of the particulate sulfur reagent and about 10-30% of the phosphorous reagent.

Exemplary Embodiment (3): A mixture containing at least one particulate sulfur reagent, and at least one particulate ammonium reagent. In exemplary compositions according to this embodiment, the composition contains from about 1% to about 99% of the particulate sulfur reagent and from about 99% to about 1% of the ammonium reagent. In other exemplary embodiments, the composition contains from about 10% to about 90% of the particulate sulfur reagent and from about 90% to about 10% of the ammonium reagent. In still further exemplary embodiments, the composition contains about 60-80% of the particulate sulfur reagent and about 10-30% of the ammonium reagent.

Exemplary Embodiment (4): A mixture containing at least one particulate sulfur reagent, and at least one particulate aluminum reagent. In exemplary compositions according to this embodiment, the composition contains from about 1% to about 99% of the particulate sulfur reagent and from about 99% to about 1% of the aluminum reagent. In other exemplary compositions according to this embodiment, the composition contains from about 50% to about 90% of the particulate sulfur reagent and from about 50% to about 4% of the aluminum reagent. In still further exemplary compositions according to this embodiment, the composition contains about 60-75% of the particulate sulfur reagent and about 5-10% of the aluminum reagent. In other exemplary embodiments, the composition contains from about 10% to about 50% of the particulate sulfur reagent and from about 80% to about 20% of the aluminum reagent. In still further exemplary embodiments, the composition contains about 20-30% of the particulate sulfur reagent and about 40-60% of the aluminum reagent.

Exemplary Embodiment (5): A mixture containing at least one particulate sulfur reagent, and at least one particulate silica reagent. In exemplary compositions according to this embodiment, the composition contains from about 1% to about 99% of the particulate sulfur reagent and from about 99% to about 1% of the silica reagent. In other exemplary embodiments, the composition contains from about 10% to about 95% of the particulate sulfur reagent and from about 50% to about 2% of the silica reagent. In still further exemplary embodiments, the composition contains about 20-85% of the particulate sulfur reagent and about 3-5% of the silica reagent. Exemplary amounts of the particulate sulfur reagent(s) include 15-25% and 65-85%. According to this embodiment, additional components as described herein may also be added. Exemplary additives include one or more particulate materials selected from (1) a particulate carbonaceous reagent, (2) a polymer decolorant, (3) a particulate aluminum reagent, (4) a particulate phosphorous reagent, (5) a particulate bleaching earth, and (6) a particulate ammonium reagent. As will be appreciated, if additional materials are added, the weight percentage of the particulate sulfur reagent and the particulate silica reagent will decrease, but the relative amounts can remain about the same. Alternatively, the amount of particulate silica reagent can remain at about 1-10% or about 3-5% of the total composition and any additional component will reduce the amount of the particulate sulfur reagent. Representative amounts of the additional component (based on the total composition) are as described elsewhere herein.

Exemplary Embodiment (6): A mixture containing at least one particulate sulfur reagent, and at least one carbonaceous reagent. In exemplary embodiments, the composition contains from about 1% to about 99% of the particulate sulfur reagent and from about 99% to about 1% of the carbonaceous reagent. In other exemplary embodiments, the composition contains from about 10% to about 95% of the particulate sulfur reagent and from about 90% to about 5% of the carbonaceous reagent. In still further exemplary embodiments, the composition contains about 60-85% of the particulate sulfur reagent and about 10-20% of the carbonaceous reagent.

Exemplary Embodiment (7): A mixture containing at least one particulate sulfur reagent, and at least one particulate bleaching earth. In exemplary compositions according to this embodiment, the composition contains from about 1% to about 99% of the particulate sulfur reagent and from about 99% to about 1% of the particulate bleaching earth. In other exemplary embodiments, the composition contains from about 10% to about 90% of the particulate sulfur reagent and from about 90% to about 10% of the particulate bleaching earth. In still further exemplary embodiments, the composition contains about 60-70% of the particulate sulfur reagent and about 20-40% of the particulate bleaching earth. In other exemplary embodiments, the composition contains from about 10% to about 50% of the particulate sulfur reagent and from about 90% to about 10% of the particulate bleaching earth, for example about 20-40% of the particulate bleaching earth. In still further exemplary embodiments, the composition contains about 10-30% of the particulate sulfur reagent and about 10-90% of the particulate bleaching earth, for example about 20% or about 80% of the particulate bleaching earth.

Exemplary Embodiment (8): A mixture containing a combination of any of the Embodiments (1) through (7), either as tertiary component mixtures (for example, a combination of at least one particulate sulfur reagent, at least one particulate phosphorous reagent, and at least one silica reagent), or as quaternary component mixtures (for example, a combination of at least one particulate sulfur reagent, at least one particulate phosphorous reagent, at least one silica reagent, and at least one carbonaceous reagent), or as a five-component mixture (for example a combination of at least one particulate sulfur reagent, at least one particulate phosphorous reagent, at least one silica reagent, at least carbonaceous reagent, and at least one aluminum reagent), or as a six-component mixture (for example a combination of at least one particulate sulfur reagent, at least one particulate phosphorous reagent, at least one silica reagent, at least carbonaceous reagent, at least one aluminum reagent, and at least one particulate bleaching earth), or as a seven-component mixture (for example a combination of at least one particulate sulfur reagent, at least one particulate phosphorous reagent, at least one particulate ammonium reagent, at least one silica reagent, at least carbonaceous reagent, at least one aluminum reagent, and at least one particulate bleaching earth). In exemplary tertiary, quaternary, five-component, six-component, or seven-component compositions according to this embodiment, the composition contains from about 1% to about 95% (by weight) of the particulate sulfur reagent, or from about 10 to 90% of the particulate sulfur reagent, or from about 15 to 85% of the particulate sulfur reagent. In exemplary tertiary, quaternary, five-component, six-component, or seven-component compositions according to this embodiment, the composition contains from about 0% to about 95% (by weight) of the phosphorous reagent, or from about 10 to 90% of the phosphorous reagent, or from about 10 to 30% of the phosphorous reagent. In exemplary tertiary, quaternary, five-component, six-component, or seven-component compositions according to this embodiment, the composition contains from about 0% to about 95% (by weight) of the aluminum reagent, or from about 5 to 90% of the aluminum reagent, or from about 5 to 0% or from about 40% to 60% of the aluminum reagent. In exemplary tertiary, quaternary, five-component, six-component, or seven-component compositions according to this embodiment, the composition contains from about 0% to about 95% (by weight) of the silica reagent, or from about 3 to 90% of the silica reagent, or from about 3 to 15% of the silica reagent. In exemplary tertiary, quaternary, five-component, six-component, or seven-component compositions according to this embodiment, the composition contains from about 0% to about 95% (by weight) of the carbonaceous reagent, or from about 5 to 90% of the carbonaceous reagent, or from about 5 to 25% of the carbonaceous reagent. In exemplary tertiary, quaternary, five-component, six-component, or seven-component compositions according to this embodiment, the composition contains from about 0% to about 95% (by weight) of the particulate bleaching earth, or from about 5 to 90% of the particulate bleaching earth, or from about 15 to 85% of the particulate bleaching earth. In exemplary tertiary, quaternary, five-component, six-component, or seven-component compositions according to this embodiment, the composition contains from about 0% to about 95% (by weight) of the ammonium reagent, or from about 10 to 90% of the ammonium reagent, or from about 10 to 30% of the ammonium reagent.

Exemplary Embodiment (9): A mixture containing at least one particulate carbonaceous reagent, and at least one polymer decolorant. In exemplary embodiments, the composition contains from about 50% to about 90% (by weight) of the carbonaceous reagent and from about 50% to about 10% (by weight) of the polymer decolorant. In other exemplary embodiments, the composition contains from about 50% to about 75% of the carbonaceous reagent and from about 50% to about 25% of the polymer decolorant. In still further exemplary embodiments, the composition contains from about 60% to about 70% of the carbonaceous reagent and from about 40% to about 30% of the polymer decolorant.

Exemplary Embodiment (10): A mixture containing at least one particulate carbonaceous and at least one polymer decolorant, mixed with any combination of one or more of the particulate materials selected from (1) a particulate sulfur reagent, (2) a particulate silica reagent, (3) a particulate aluminum reagent, (4) a particulate phosphorous reagent, (5) a particulate bleaching earth, and (6) a particulate ammonium reagent. This embodiment would therefore include tertiary, quaternary, five-composite, six-composite, seven-component compositions, or eight-component compositions. In exemplary tertiary, quaternary, and five, six, and seven component compositions, according to this embodiment, the composition contains from about 10% to about 90% (by weight) of the carbonaceous reagent, or from about 5 to 75% of the carbonaceous reagent, or from about 5 to 25% of the carbonaceous reagent. In exemplary tertiary, quaternary, and five, six, seven and eight component compositions, according to this embodiment, the composition contains from about 5% to about 45% (by weight) of the polymer decolorant, or from about 10 to 40% of the polymer decolorant, or from about 20 to 40% of the polymer decolorant. In exemplary tertiary, quaternary, and five, six, seven and eight component compositions, according to this embodiment, the composition contains from about 0% to about 90% (by weight) of the particulate sulfur reagent, or from about 3 to 85% of the particulate sulfur reagent, or from about 10 to 85% of the particulate sulfur reagent. In exemplary tertiary, quaternary, and five, six, seven and eight component compositions, according to this embodiment, the composition contains from about 0% to about 45% (by weight) of the phosphorous reagent, or from about 3 to 30% of the phosphorous reagent, or from about 5 to 25% of the phosphorous reagent. In exemplary tertiary, quaternary, and five, six, seven and eight component compositions, according to this embodiment, the composition contains from about 0% to about 45% (by weight) of the aluminum reagent, or from about 3 to 30% of the aluminum reagent, or from about 3 to 15% of the aluminum reagent, or from about 40 to 60% of the aluminum reagent. In exemplary tertiary, quaternary, and five, six, seven and eight component compositions, according to this embodiment, the composition contains from about 0% to about 45% (by weight) of the silica reagent, or from about 3 to 30% of the silica reagent, or from about 3 to 15% of the silica reagent. In exemplary tertiary, quaternary, and five, six, seven and eight component compositions, according to this embodiment, the composition contains from about 0% to about 90% (by weight) of the particulate bleaching earth, or from about 5 to 40% of the particulate bleaching earth, or from about 10 to 35% of the particulate bleaching earth or from about 50 to 90% of the particulate bleaching earth or from about 70 to 85% of the particulate bleaching earth. In exemplary tertiary, quaternary, and five, six, seven and eight component compositions, according to this embodiment, the composition contains from about 0% to about 45% (by weight) of the ammonium reagent, or from about 3 to 30% of the ammonium reagent, or from about 5 to 25% of the ammonium reagent.

Exemplary Embodiment (11): A mixture containing at least one particulate sulfur reagent, at least one particulate silica reagent, at least one particulate aluminum reagent, at least one particulate phosphorous reagent, and at least one particulate carbonaceous reagent. In exemplary embodiments, the composition contains from about 1-99% of the particulate sulfur reagent, from about 1-25% of the silica reagent, from about 2-15% of the aluminum reagent, from about 5-25% of the phosphorous reagent, and from about 1-20% of the carbonaceous reagent. In other exemplary embodiments, the composition contains from about 25-90% of the particulate sulfur reagent, from about 1-10% of the silica reagent, from about 5-10% of the aluminum reagent, from about 10-20% of the phosphorous reagent, and from about 5-15% of the carbonaceous reagent. In still further exemplary embodiments, the composition contains from about 60-70% of the particulate sulfur reagent, from about 2-7% of the silica reagent, from about 5-10% of the aluminum reagent, from about 12-18% of the phosphorous reagent, and from about 7-12% of the carbonaceous reagent. Although any suitable particulate sulfur reagents, particulate silica reagents, particulate aluminum reagents, particulate phosphorous reagents, and particulate carbonaceous reagents can be used, exemplary embodiments utilize sodium metabisulfite as the least one of the particulate sulfur reagent, and/or monosodium phosphate or monoammonium phosphate as the at least one particulate phosphorous reagent; and/or amorphous silica as the at least one particulate silica reagent, and/or polyaluminum chloride as the at least one particulate aluminum reagent; and/or powder activated carbon as the at least one particulate carbonaceous reagent.

Exemplary Embodiment (12): A mixture containing at least one particulate sulfur reagent, at least one particulate silica reagent, and at least one particulate bleaching earth. In exemplary embodiments, the composition contains from about 1-50% of the particulate sulfur reagent, from about 1-25% of the silica reagent, and from about 50-99% of the bleaching earth. In other exemplary embodiments, the composition contains from about 5-25% of the particulate sulfur reagent, from about 1-10% of the silica reagent, and from about 60-95% of the bleaching earth. In still further exemplary embodiments, the composition contains from about 10-20% of the particulate sulfur reagent, from about 3-7% of the silica reagent, and from about 70-90% of the bleaching earth. Although any suitable particulate sulfur reagents, particulate silica reagents, and bleaching earth can be utilized, exemplary embodiments utilize sodium hydrosulfite as the least one of the particulate sulfur reagent and/or amorphous silica as the at least one silica reagent.

Exemplary Embodiment (13): A mixture containing at least one particulate sulfur reagent, at least one particulate silica reagent, and at least one particulate bleaching earth. In exemplary embodiments, the composition contains from about 1-99% of the particulate sulfur reagent, from about 1-25% of the silica reagent, and from about 10-80% of the bleaching earth. In other exemplary embodiments, the composition contains from about 25-90% of the particulate sulfur reagent, from about 1-10% of the silica reagent, and from about 20-65% of the bleaching earth. In still further exemplary embodiments, the composition contains from about 60-70% of the particulate sulfur reagent, from about 3-7% of the silica reagent, and from about 25-35% of the bleaching earth. Although any suitable particulate sulfur reagents, particulate silica reagents, and bleaching earth can be utilized, exemplary embodiments utilize sodium metabisulfite, sodium hydrosulfite or a mixture thereof as the least one of the particulate sulfur reagent and/or amorphous silica as the at least one silica reagent. When a mixture of sodium metabisulfite and sodium hydrosulfite is utilized, the ratio can be from about 1:5 sodium metabisulfite to sodium hydrosulfite to 5:1 sodium metabisulfite to sodium hydrosulfite. In exemplary embodiments, the ratio of sodium metabisulfite to sodium hydrosulfite is between about 1:1 and about 5:1, between about 3:1 and about 4:1 or about 3.3:1.

Exemplary Embodiment (14): A mixture containing at least one particulate sulfur reagent, at least one particulate silica reagent, at least one particulate aluminum reagent, and at least one particulate bleaching earth. In exemplary embodiments, the composition contains from about 1-75% of the particulate sulfur reagent, from about 1-25% of the silica reagent, from about 25-75% of the aluminum reagent, and from about 10-80% of the bleaching earth. In other exemplary embodiments, the composition contains from about 10-50% of the particulate sulfur reagent, from about 1-10% of the silica reagent, from about 35-65% of the aluminum reagent, and from about 10-50% of the bleaching earth. In still further exemplary embodiments, the composition contains from about 15-35% of the particulate sulfur reagent, from about 3-7% of the silica reagent, from about 40-60% of the aluminum reagent, and from about 15-25% of the bleaching earth. Although any suitable particulate sulfur reagents, particulate silica reagents, particulate aluminum reagent, and bleaching earth can be utilized, exemplary embodiments utilize sodium metabisulfite as the at least one particulate sulfur reagent; and/or amorphous silica as the at least one particulate silica reagent; and/or polyaluminum chloride as the at least one particulate aluminum reagent.

Exemplary Embodiment (15): A mixture containing at least one particulate sulfur reagent, at least one particulate silica reagent, and at least one particulate phosphorous reagent. In exemplary embodiments, the composition contains from about 1-99% of the particulate sulfur reagent, from about 1-25% of the silica reagent, and from about 1-75% of the phosphorous reagent. In other exemplary embodiments, the composition contains from about 50-90% of the particulate sulfur reagent, from about 1-10% of the silica reagent, and from about 10-50% of the phosphorous reagent. In still further exemplary embodiments, the composition contains from about 60-80% of the particulate sulfur reagent, from about 3-7% of the silica reagent, and from about 15-35% of the phosphorous reagent. Although any suitable particulate sulfur reagents, particulate silica reagents, and particulate phosphourous reagents can be utilized, exemplary embodiments utilize sodium metabisulfite as the at least one particulate sulfur reagent; and/or monosodium phosphate or monoammonium phosphate as the at least one particulate phosphourous reagent; and/or amorphous silica as the at least one particulate silica reagent.

Exemplary Embodiment (16): A mixture containing at least one particulate sulfur reagent, at least one particulate silica reagent, and at least one particulate carbonaceous reagent. In exemplary embodiments, the composition contains from about 1-99% of the particulate sulfur reagent, from about 1-25% of the silica reagent, and from about 5-50% of the carbonaceous reagent. In other exemplary embodiments, the composition contains from about 50-90% of the particulate sulfur reagent, from about 1-10% of the silica reagent, and from about 10-30% of the carbonaceous reagent. In still further exemplary embodiments, the composition contains from about 70-85% of the particulate sulfur reagent, from about 3-7% of the silica reagent, and from about 10-25% of the carbonaceous reagent. Although any suitable particulate sulfur reagents, particulate silica reagents, and particulate carbonaceous reagents can be utilized, exemplary embodiments utilize sodium metabisulfite, sodium hydrosulfite or a mixture thereof as the at least one particulate sulfur reagent; and/or amorphous silica as the at least one particulate silica reagent; and/or powder activated carbon as the at least one particulate carbonaceous reagent. When a mixture of sodium metabisulfite and sodium hydrosulfite is utilized, the ratio can be from about 1:5 sodium metabisulfite to sodium hydrosulfite to 5:1 sodium metabisulfite to sodium hydrosulfite. In exemplary embodiments, the ratio of sodium metabisulfite to sodium hydrosulfite is between about 1:1 and about 5:1, between about 3:1 and about 5:1 or about 4.5:1.

Any combinations of the mixtures of components listed in Exemplary Embodiments (1) through (15) can be utilized in the process of the present invention.

The compositions of the invention are added to the sugar juice or syrup by way of a solids dosing method added directly to the sugar process (continuous or batch solids dosing using, e.g., a screw conveyor), or a liquid dosing method wherein one r more of the compositions are first added to water (or other suitable liquid, such as sugar juice or syrup), and pumped into the sugar process. As used herein, liquid includes slurries, suspensions and solutions. Other suitable means of adding a solid and for a liquid can also be used. In some embodiments where both a solid and a liquid are added, some components can be added by solid dosing while others are added by pumping. The compositions can be added at any point in the sugar purification or clarification process. For example, the compositions can be added to the sugar juice or syrup in the juice or syrup clarifier tank or prior to reaching the juice or syrup clarifier tank. In exemplary embodiments, the composition is added after sulfitation, before sulfitation, or the composition is utilized instead of sulfitation. When flocculation is utilized after sulfitation, the composition can also be used before, after or during flocculation. Alternatively, the composition is used instead of flocculation. In some embodiments, the compositions have at least some contact time with the sugar juice or syrup prior to reaching the juice or syrup clarifier tank. For example, the compositions can have at least about 3 minutes of contact time with the sugar juice or syrup prior to reaching the juice or syrup clarifier, and at least about 10 minutes of contact time with the sugar juice or syrup prior to reaching the juice or syrup clarifier tank. In some embodiments, the compositions can be added directly to the juice or syrup clarifier tank. In some embodiments, the compositions can be added even if there is no distinguishable clarifier tank available; in this function the compositions can be seen to produce clarification without the assistance of any other chemical.

In exemplary embodiments, a composition according to the invention is added in an amount or dosage to achieve a concentration in the sugar juice or syrup of from about 5 ppm to about 500 ppm. In exemplary embodiments, the composition is added at a dosage to achieve a concentration of from about 10 ppm to about 250, ppm, from about 10 ppm to about 100 ppm, from about 25 ppm to about 250 ppm or from about 25 ppm to about 100 ppm. In some embodiments, a composition according to the invention is added in an amount or dosage to achieve a concentration in the sugar juice or syrup of about 10 ppm, about 25 ppm, about 50 ppm, about 75 ppm, or about 100 ppm. In some embodiments, a composition according to the invention is added in an amount or dosage to achieve a concentration in the sugar juice or syrup of at least about 10 ppm, at least about 25 ppm, at least about 50 ppm, at least about 75 ppm, or at least about 100 ppm. In some embodiments, a composition according to the invention is added in an amount or dosage to achieve a concentration in the sugar juice or syrup of less than about 1000 ppm, less than about 500 ppm, less than about 250 ppm, or less than about 100 ppm.

EXAMPLES

The following examples illustrate some compositions, usage methods, and advantages as described heretofore. The examples are illustrations of point only, and are not intended to limit the scope of our invention.

Example 1

A composition (designated as "Composition #1" hereafter) was prepared containing 64% sodium metabisulfite ($Na_2S_2O_5$), 16% monosodium phosphate ($NaH_2PO_4$), 10% powder activated carbon, 6.5% of particulate polyaluminum chloride, and 3.5% of amorphous silica. Composition #1 was added to the raw juice at a sugar mill laboratory at a dosage of 50 ppm (weight Composition #1/weight of juice), and contacted with the raw juice for approximately 5 minutes. The color reduction in the juice of Composition #1 is shown in Table 1:

TABLE 1

Color removal in the juice with Composition #1 only

| Method | Initial Juice Color | Final Juice Color | % Color Reduction |
|---|---|---|---|
| Juice Treated with Composition #1 | 14900 | 9900 | 33% |

As seen in Table 1, a significant improvement in juice clarity, as measured by juice color, was achieved with the use of Composition #1.

Example 2

Four separate compositions (designated as "Composition #2, #3, #4, and #5 hereafter) were prepared. Composition #2 contained 80% bleaching earth, 15% sodium hydrosulfite ($Na_2S_2O_4$), and 5% of amorphous silica. Composition #3 contained 50% sodium metabisulfite ($Na_2S_2O_5$), 30% bleaching earth, 15% sodium hydrosulfite, and 5% of amorphous silica. Composition #4 contained 50% particulate polyaluminum chloride, 25% sodium metabisulfite (($Na_2S_2O_5$), 20% bleaching earth, and 5% amorphous silica. Composition #5 contained of 71.5% sodium metabisulfite ($Na_2S_2O_5$), 24% monosodium phosphate ($NaH_2PO_4$), and 4.5% of amorphous silica. The compositions were added to the raw juice at a sugar mill laboratory, and contacted with the raw juice for approximately 5 minutes. The color reductions in the juice for the various compositions, is seen in Table 2:

TABLE 2

Color removal in the juice with Composition #2, #3, #4, and #5

| Method | Initial Juice Color | Final Juice Color | % Color Reduction |
|---|---|---|---|
| Juice Treated with 100 ppm Composition #2 | 13,400 | 11,300 | 15% |
| Juice Treated with 100 ppm Composition #3 | 13,400 | 11,200 | 16% |
| Juice Treated with 100 ppm Composition #4 | 13,400 | 11,900 | 11% |
| Juice Treated with 50 ppm Composition #5 | 13,400 | 10,300 | 23% |

As seen in Table 2, significant improvements in juice clarity, as measured by juice color, were achieved with the use of Composition #2, Composition #3, Composition #4, and Composition #5.

Example 3

A composition (designated as "Composition #6" hereafter) was prepared containing 66% sodium metabisulfite ($Na_2S_2O_5$), 15% sodium hydrosulfite ($Na_2S_2O_4$), 16% powder activated carbon, and 3% of amorphous silica. Composition #6 was added to the raw juice at a sugar mill process, at a dosage of 50 ppm (weight Composition #6/weight of juice), and contacted with the raw juice for approximately 5 minutes prior to the juice entering the normal clarification process. The weight percentage of various color ranges of crystal sugars produced with Composition #6, compared to the traditional process prior to the use of Composition #6, are as seen in Table 3:

As seen in Table 3, a significant increase in the lower color crystal sugars (Type A and Type B) was achieved with the use of Composition #6 added to the raw juice, compared to the traditional process without the use of Composition #6. The lower color crystal sugars are typically sold at a market premium. Additionally, it is well-known in the art that if the lower color crystal sugars were not desirable (due to no market premium for example), then the washing time of the crystal sugar centrifugals can be reduced. Reducing the wash time of the crystal sugars in the centrifugals can result in an increase in daily crystal sugar produced; therefore if the lower color crystal sugars were not desirable, then this mill could have instead realized a gain in the amount of total daily crystal sugar produced by reducing the wash time of the crystal sugars in the centrifugals.

TABLE 3

Weight percentage of crystal sugar produced within the specified color ranges with Composition #6 compared to the traditional process without Composition #6

| Method | Blanco Sugar (181-250 IU Color) | Type A (100-140 IU Color) | Type B (141-180 IU Color) | Type A + Type B |
|---|---|---|---|---|
| Crystal Sugar produced with Composition #6 | 25.3% | 30.5% | 44.2% | 74.7% |
| Crystal Sugar produced without Composition #6 | 72.9% | 7.3% | 19.8% | 27.1% |

The present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the composition or method shown is intended only for illustration and disclosure of an operative embodiment and not to show all of the various forms or modifications in which this invention might be embodied or operated. The present invention has been described in considerable detail; however, such detailed description is not intended in any way to limit the broad features or principles of the present invention, or the scope of the patent to be granted. Therefore, the invention is to be limited only by the scope of the appended claims.

What is claimed is:

1. A process of sugar mill processing a sugar juice or a sugar syrup comprising adding a composition to the sugar juice or sugar syrup in a sugar mill wherein the composition comprises:

a mixture of at least one particulate sulfur reagent containing at least one sulfur atom and at least three oxygen atoms;

at least one particulate phosphorous reagent selected from monosodium phosphate and monoammonium phosphate; and one or more particulate solids selected from the group consisting of: (A) a silica reagent, (B) a particulate carbonaceous reagent, (C) a particulate aluminum reagent containing at least one aluminum atom and at least three oxygen atoms in the chemical formula, (D) a particulate filter aid, (E) a polymer decolorant, (F) a particulate ammonium reagent having at least one ammonium group ($NH_4$) in the chemical formula, and (G) a bleaching earth.

2. The process of claim 1, wherein the composition comprises at least one particulate silica reagent.

3. The process of claim 1 or claim 2, wherein the composition comprises at least one bleaching earth.

4. The process of claim 1 or claim 2, wherein the composition comprises at least one particulate aluminum reagent.

5. The process of claim 1 or claim 2, wherein the composition comprises at least one particulate carbonaceous reagent.

6. The process of claim 1 or claim 2 wherein the particulate sulfur reagent is sodium metabisulfite, sodium hydrosulfite or a mixture thereof.

7. The process of claim 2 wherein the particulate silica reagent is amorphous silica.

8. The process of claim 4 wherein the particulate aluminum reagent is polyaluminum chloride.

9. The process of claim 5 wherein the particulate carbonaceous reagent is powder activated carbon.

10. The process according to claim 1 or claim 2, wherein the composition is added to the sugar juice or syrup prior to reaching the juice or syrup clarifier tank.

* * * * *